US011211218B2

(12) United States Patent
Garavelli et al.

(10) Patent No.: US 11,211,218 B2
(45) Date of Patent: Dec. 28, 2021

(54) METHOD FOR DETECTING INSUFFICIENT CONTACT PRESSURE IN A SWITCHING UNIT, DEVICE FOR IMPLEMENTING SUCH A METHOD, AND SWITCHING UNIT INCLUDING SUCH A DEVICE

(71) Applicant: Schneider Electric Industries SAS, Rueil-Malmaison (FR)

(72) Inventors: Jordane Garavelli, Saint Egreve (FR); Steeve Becker, Grenoble (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 245 days.

(21) Appl. No.: 16/445,380

(22) Filed: Jun. 19, 2019

(65) Prior Publication Data

US 2020/0020498 A1 Jan. 16, 2020

(30) Foreign Application Priority Data

Jul. 12, 2018 (FR) ..... 18 56445

(51) Int. Cl.
*H01H 71/04* (2006.01)
*H01H 11/00* (2006.01)
(Continued)

(52) U.S. Cl.
CPC ..... *H01H 71/04* (2013.01); *H01H 11/0062* (2013.01); *H01H 33/40* (2013.01);
(Continued)

(58) Field of Classification Search
CPC ..... H01H 1/0015; H01H 1/50; H01H 3/26; H01H 3/30; H01H 11/0062; H01H 33/36;
(Continued)

(56) References Cited

U.S. PATENT DOCUMENTS

2013/0103334 A1 4/2013 Delbaere et al.
2017/0047184 A1 2/2017 Ashtekar et al.

FOREIGN PATENT DOCUMENTS

EP 1 555 683 A1 7/2005
EP 2 584 575 A1 4/2013

OTHER PUBLICATIONS

French Preliminary Search Report dated Apr. 11, 2019 in French Application 18 56445 filed on Jul. 12, 2018 (with Translation of Categories of Cited Documents and Written Opinion).

*Primary Examiner* — Kevin J Comber
(74) *Attorney, Agent, or Firm* — Oblon, McClelland, Maier & Neustadt, L.L.P.

(57) ABSTRACT

A method for detecting insufficient contact pressure between two contacts of an electrical switching unit, including a device for resetting a mechanism for controlling the switching unit following a closure maneuver of the mechanism, the resetting device including a motor configured to complete the closure maneuver of the control mechanism. The method involves detecting whether the motor completes the closure and whether a resetting torque corresponds to a normal resetting torque, by analyzing an envelope curve of current consumed by the motor over time, and, if the motor completes the closure, deducing that a wear is a result of wear in the mechanism or a kinematic chain, and if the motor completes the closure and the resetting torque corresponds to an abnormal rescuing torque, deducing that the wear corresponds to wear in the motor or parts involved in compressing the closure spring.

12 Claims, 3 Drawing Sheets

(51) Int. Cl.
*H01H 33/40* (2006.01)
*H01H 3/30* (2006.01)

(52) U.S. Cl.
CPC ..... *H01H 2003/3094* (2013.01); *H01H 2071/044* (2013.01)

(58) Field of Classification Search
CPC ..... H01H 33/40; H01H 71/04; H01H 71/70; H01H 2003/3094; H01H 2071/044
USPC ..... 361/115
See application file for complete search history.

METHOD FOR DETECTING INSUFFICIENT CONTACT PRESSURE IN A SWITCHING UNIT, DEVICE FOR IMPLEMENTING SUCH A METHOD, AND SWITCHING UNIT INCLUDING SUCH A DEVICE

TECHNICAL FIELD

The present invention relates to a method for detecting insufficient contact pressure between the two contacts of an electrical switching unit, said unit comprising means for resetting the mechanism for controlling the switching unit following closure of the mechanism, said means comprising means for compressing a closure spring intended to bring the mechanism for controlling the unit to a position in which it is ready to close, said resetting means also comprising a motor able to complete the closure manoeuvre of the control mechanism, in the event of incomplete closure by said control mechanism and before carrying out the resetting, said insufficient contact pressure being the result of wear in the mechanism, the kinematic chain, the motor, the parts involved in compressing the closure spring, or in the event of incomplete closure exclusive of any wear, for example, during periods of low temperatures that cause the greases to freeze.

The present invention also relates to a detection device for implementing this method, as well as to a switching unit such as a circuit breaker comprising such a device.

PRIOR ART

A device for manoeuvring circuit breakers is known, such as that disclosed in document EP0 221 430, that allows a fast cycle to be carried out for opening, closing and reopening a circuit breaker, commonly called OCO, the circuit breaker comprising a set of fixed contacts and a set of movable contacts, a manoeuvring rod intended to be connected to said set of movable contacts, a first spring transferring, when it expands, a movement to the rod in the direction corresponding to the opening of the circuit breaker, a second spring transferring, when it expands, a movement to the rod in the direction corresponding to the closure of the circuit breaker, said device comprising means for ensuring that the expansion of the second spring leads to the resetting of the first spring, each of said springs being connected to a controllable locking component.

In such circuit breakers, the control mechanism always has to be reset following a closure.

These units can experience varied phenomena, such as very frequent use, corrosion, use at low temperature, etc. These conditions can lead to the deterioration of the unit, particularly wear in the mechanism, the kinematic chain, the motor, or specifically in the parts for compressing the closure spring.

This wear in the mechanism, the kinematic chain or use at low temperature will result in incomplete closure of the contacts of the unit during a manoeuvre for closing the unit. This incomplete closure leads to partial contact pressure in the vacuum tubes, and more broadly, in the switching components.

When the mechanism is of the OCO cam type, i.e. a mechanism allowing fast closure of the unit (0.3 sec) to be carried out following the opening thereof, with said mechanism comprising cam transmission means located between the shaft connected to the closure spring and the shaft connected to the parts of the kinematic chain driving the movable contacts, and when closure of the mechanism is incomplete, this closure is completed by the motor during the resetting following the closure. This does not pose a problem when such closure is carried out on a nominal current. If the current is higher, the existence of this partial contact pressure before complete closure by the motor can lead to overheating and even destruction if the current level reaches the permissible short duration level or if there is a short circuit.

When the resetting is not carried out by a motor, the aforementioned problems resulting from incomplete closure occur even during closure on a nominal current.

It is important to detect the aforementioned wear and incomplete closure, since this is used to indicate the need to perform maintenance and/or to better protect the unit against the environmental conditions.

Switching units are known that comprise means for providing information relating to the actual path of the movable contacts, with this allowing detection of the existence of wear in the contacts and the information to be communicated in situ, particularly via light signalling means, or remotely, via an electrical signal. These means nevertheless do not allow detection of the aforementioned wear and incomplete closure of the contacts.

DISCLOSURE OF THE INVENTION

The present invention overcomes these problems and proposes a method for detecting wear in the mechanism, the kinematic chain, the motor or the parts for compressing the closure spring, as well as incomplete closure, said method allowing a distinction to be made between wear in the mechanism, in the kinematic chain, incomplete closure exclusive of any wear, from wear in the motor or in the specific parts of the mechanism for compressing the closure spring.

A further aim of the invention is a device for implementing this method, as well as an electrical switching unit comprising such a device.

To this end, the aim of the present invention is a method for detecting insufficient contact pressure between the two contacts of an electrical switching unit of the aforementioned type, said method being characterized in that it involves detecting whether the motor completes the closure and/or whether the resetting torque corresponds to a resetting torque called normal resetting torque, by analysing the envelope curve of current consumed by the motor over time, in order to carry out the resetting following the closure manoeuvre of the control mechanism, and, if the motor completes the closure, deducing that the wear is the result of wear in the mechanism, the kinematic chain or even in the motor, and/or if the resetting torque corresponds to an abnormal resetting torque, deducing that the wear corresponds to wear in the motor or even in the parts involved in compressing the closure spring.

According to a particular feature, if the motor has completed the closure it is detected by analysing the envelope curve of current consumed by the motor over time, in order to carry out the resetting following the closure manoeuvre of the control mechanism, and by verifying whether the duration of this current has increased compared to a current duration, called normal duration, corresponding to complete closure, with this increase in the duration of the current being characteristic of wear in the mechanism, the kinematic chain, or of incomplete closure exclusive of any wear.

It is to be noted that the kinematic chain comprises the parts located between the mechanism and the contacts, and which transfer the movements provided by the mechanism to the movable contacts.

According to another feature, if the motor encounters a normal or particularly high resetting torque it is detected by analysing the envelope curve of current consumed by the motor over time, in order to complete the resetting following the closure manoeuvre of the control mechanism, and by verifying whether the current level has increased compared to the current level, called normal level, corresponding to the case whereby there is neither wear in the motor nor wear in the specific parts of the mechanism involved in compressing the closure spring.

According to another feature, the envelope curve of current consumed by the motor for the resetting operation is compared with an envelope curve of current, called standard curve, corresponding to the envelope curve of current consumed by the motor when the closure carried out by the control mechanism is complete, and it is thereby deduced whether or not the closure has been completed.

According to another feature, a range of duration of the current passing through the motor is defined and, for any current duration found within this range, it is deduced that there is normal operation without wear in the motor and in the specific parts of the mechanism for compressing the closure spring.

According to another feature, an envelope is defined that is delimited by two envelope curves of current, called end curves, and any envelope curve of current located within this envelope between these two envelope curves expresses normal operation of the motor and of the parts involved in compressing the closure spring.

A further aim of the present invention is a detection device for implementing a method comprising the aforementioned features taken individually or in combination, said device being characterized in that it comprises current detection means that are connected to the means for powering the motor, and a processing algorithm able to compare the envelope curve of current consumed by the motor for the resetting, over time, with an envelope curve of current, called normal curve, corresponding to complete closure carried out by the control mechanism and/or to a normal resetting torque.

According to another feature, this device comprises current detection means that are connected to the means for powering the motor, and a processing algorithm able to compare the envelope curve of current consumed by the motor for the resetting, over time, with the two aforementioned end envelope curves and/or with the aforementioned normal range of duration, and able to determine whether this envelope curve of consumed current is found within or even outside the aforementioned envelope, or even whether the current duration is found within or outside the range.

According to another feature, the aforementioned resetting means comprise means for storing the closure energy in the control mechanism.

According to another feature, this device comprises means for locally or remotely indicating the detection of one of the aforementioned wear conditions.

A further aim of the present invention is an electrical switching unit, said unit being characterized in that it comprises a detection device comprising the aforementioned features taken individually or in combination.

According to another feature, this unit is a circuit breaker of the OCO type, comprising means for resetting the control mechanism of the circuit breaker that are able to return the mechanism to a position in which it is ready to close, following a closure manoeuvre.

However, other advantages and features of the invention will become more clearly apparent from the following detailed description, which refers to the accompanying drawings, which are provided solely by way of an example, and in which:

DESCRIPTION OF THE FIGURES

FIG. 1 is an envelope curve showing the current consumed by the motor during the resetting on the basis of the resetting duration, during normal operation of the switching unit;

FIG. 2 shows two curves, one of which corresponds to normal operation of the unit, and the other one of which corresponds to incomplete closure of the contacts of the unit; and FIG. 3 shows two curves, one of which corresponds to normal operation, and the other one of which corresponds to a high resetting torque.

DETAILED DESCRIPTION OF SEVERAL EMBODIMENTS OF THE INVENTION

Figure 1:
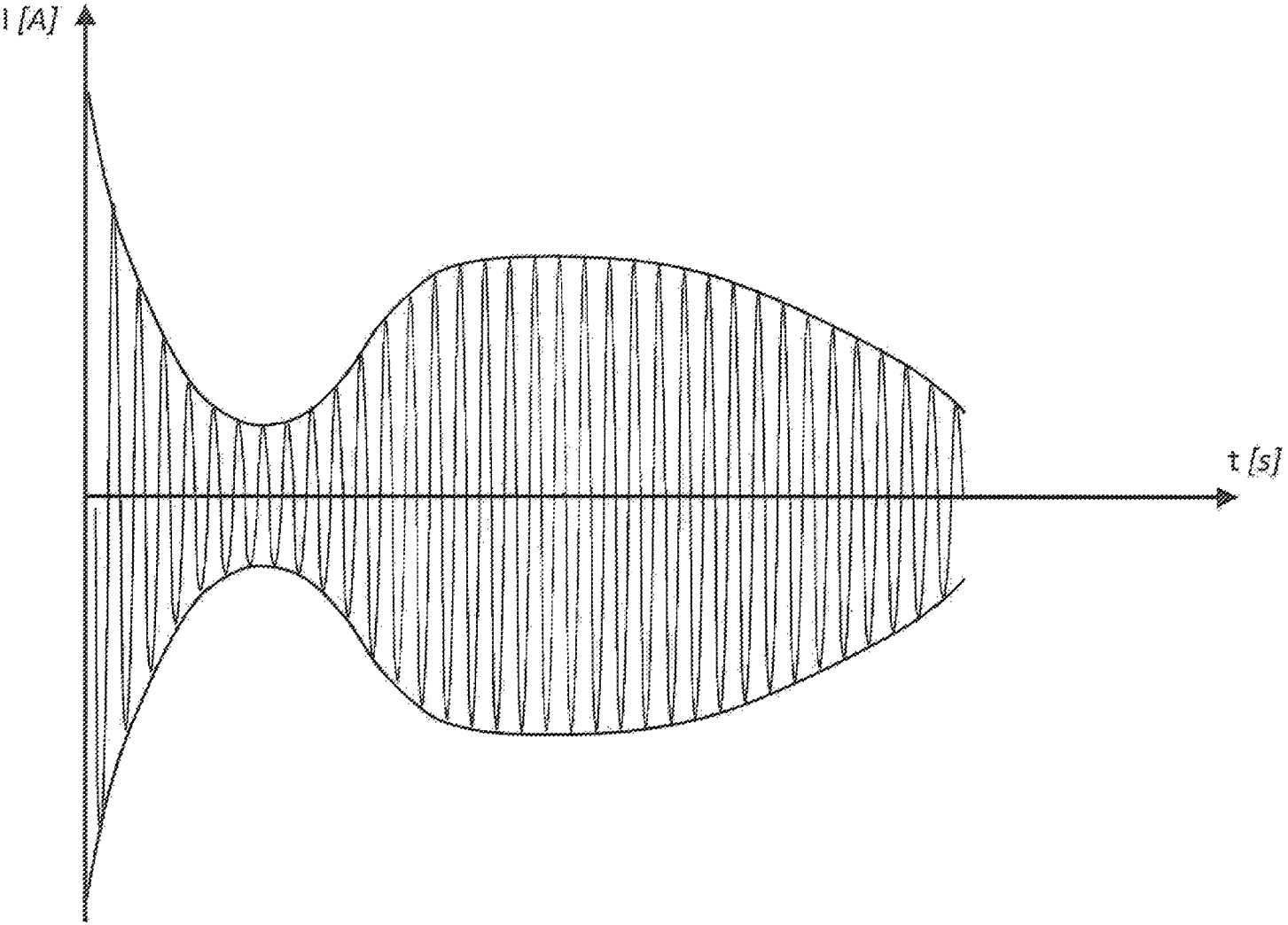
FIGS. 1 to 3 are three graphical representations showing curves representing the current consumed by the motor during the resetting on the basis of the resetting duration.

FIG. 1 shows an envelope curve representing the current consumed by a motor, said motor being intended to carry out the resetting of a mechanism for controlling the contacts of a switching unit, such as a medium voltage circuit breaker, on the basis of the duration of this resetting.

More specifically, these resetting means comprise means for storing the closure energy in the control mechanism so as to bring this control mechanism to a position in which it is ready to close the contacts of the unit. Advantageously, these resetting means comprise a closure spring.

Figure 2:
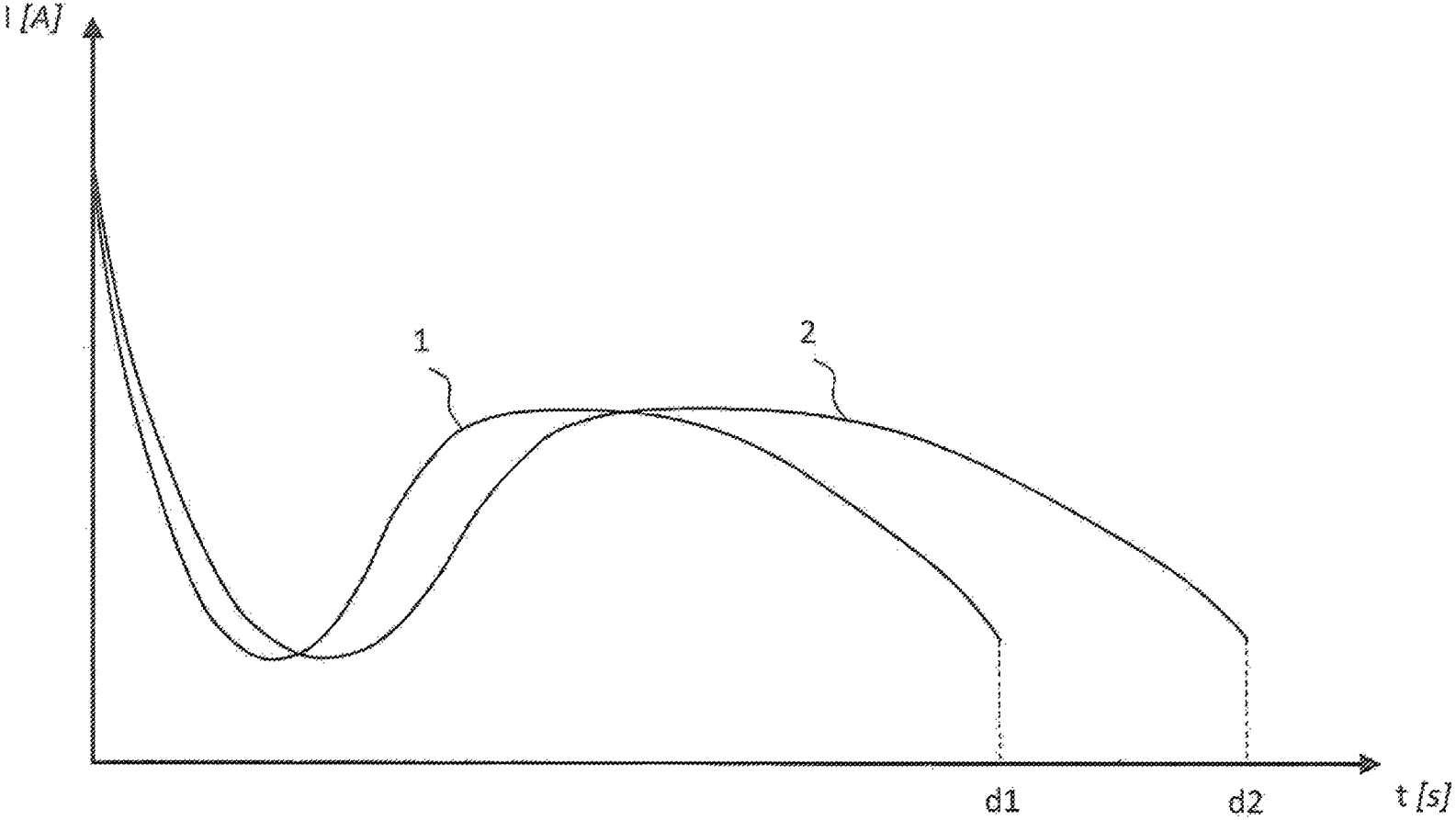

In FIG. 2, the first curve 1 corresponds to normal operation without any wear inside the switching unit, whereas the second curve 2 corresponds to incomplete closure of the contacts of the unit following wear in the mechanism, the kinematic chain, or even incomplete closure of the contacts of the unit exclusive of any wear, such as incomplete closure following use at low temperature.

As shown in this FIG. 2, the resetting duration d2 is higher in the case of the second curve 2, corresponding to incomplete closure of the contacts, than in the case of the first curve 1, corresponding to normal operation of the unit.

Figure 3:
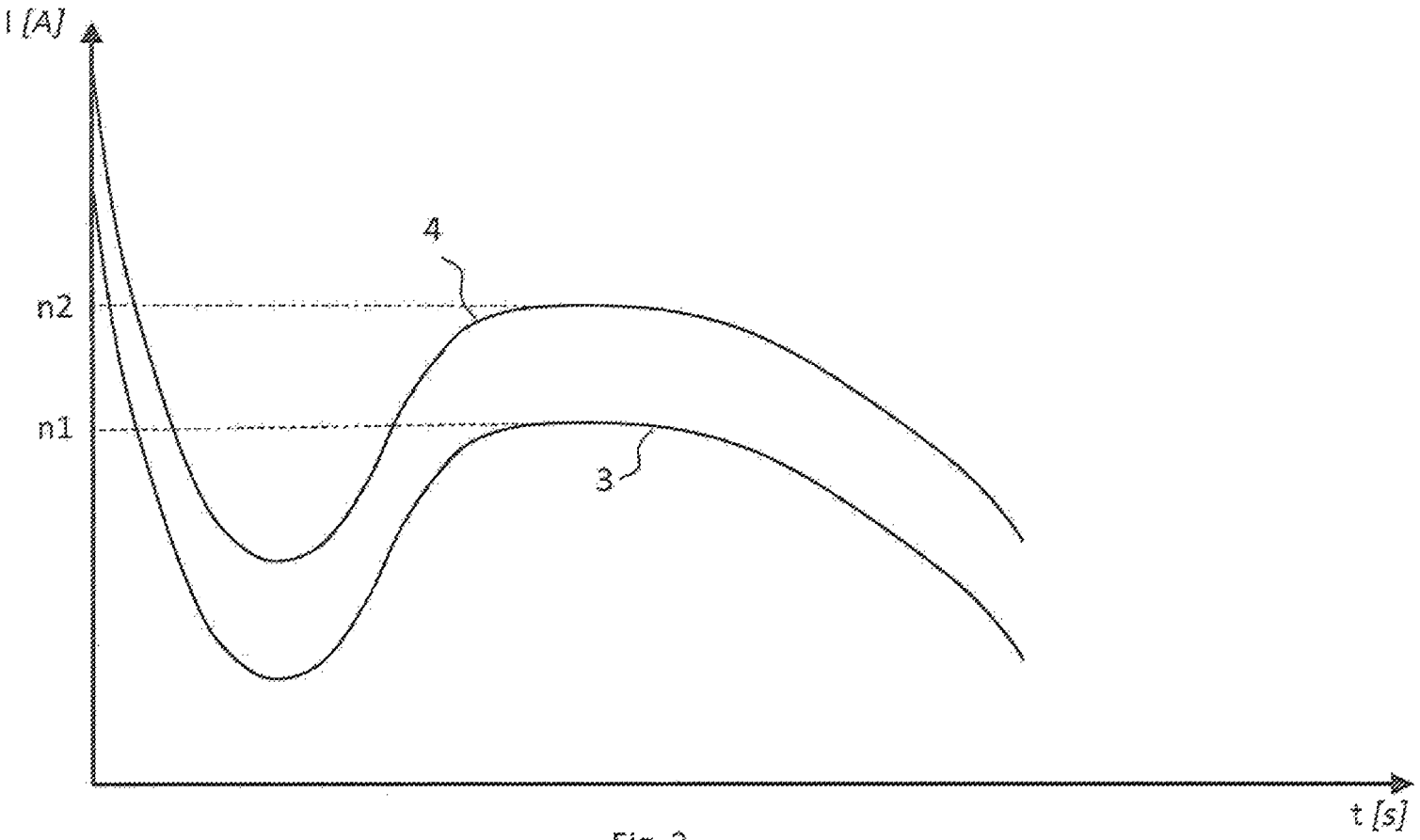

In FIG. 3, the curve 3 corresponds to normal operation of the unit, whereas the curve 4 corresponds to a switching unit exhibiting wear in the motor or specifically in the parts of the mechanism for compressing the closure spring. Thus, it appears that, in the curve 4, the maximum level n2 of current consumed by the motor is higher than the level n1 in the curve 3.

In a first embodiment of the method according to the invention, as shown in FIG. 2, incomplete closure is detected, which is characteristic of wear in the control mechanism, the kinematic chain of the switching unit, or even of incomplete closure exclusive of any wear, such as that following use at low temperature, by comparing the two curves 1 and 2, and by detecting a resetting duration d2 that is greater than that of d1 usually observed during normal operation of the device.

According to a second embodiment (not shown) of the method according to the invention, a range, or even an interval of two resetting current duration values, is defined, and the resetting duration d2 corresponding to the analysed curve is compared with this range or scope.

Similarly, as shown in FIG. 3, an abnormally high resetting torque is detected by comparing two curves, respectively representing, on the one hand, the resetting current on the basis of the resetting time, during normal operation of the unit, and, on the other hand, the resetting current on the basis of the resetting time when wear is present in the motor or specifically in the parts of the mechanism for compressing the closure spring, and by detecting a difference between the two maximum current levels n1, n2.

According to another embodiment, not shown, an envelope is defined that is delimited by two envelope curves of current, called end curves, and any envelope curve of current found within this envelope between these two envelope curves expresses normal operation of the motor and of the parts involved in compressing the closure spring.

The detection device according to a particular embodiment of the invention comprises current detection means connected to the means for powering the motor, and a processing algorithm able to compare the envelope curve of current consumed by the motor for the resetting operation, over time, with an envelope curve corresponding to normal operation of the unit, or even with the two aforementioned end envelope curves, and able to determine whether this envelope curve of consumed current is within or even outside the aforementioned envelope, or even able to compare the resetting duration with the aforementioned normal range of duration, and able to determine whether this current duration is found within or outside the range.

The present invention thus allows detection of any incomplete closure manoeuvre of a circuit breaker that can affect the performance of the unit and the safety of individuals.

Of course, the invention is not limited to the embodiments described and illustrated herein, which have been provided solely by way of an example.

On the contrary, the invention includes all the technical equivalents of the means described herein, as well as their combinations, if they are produced according to the spirit of the invention.

The invention claimed is:

1. A method for detecting insufficient contact pressure between two contacts of an electrical switching unit, said electrical switching unit comprising means for resetting a control mechanism for controlling the electrical switching unit following a closure maneuver of the control mechanism, said resetting means comprising means for compressing a closure spring intended to bring the control mechanism for controlling the electrical switching unit to a position in which the control mechanism is ready to close, and a motor configured to complete the closure maneuver of the control mechanism in an event of incomplete closure by said control mechanism and before carrying out the resetting as a result of said insufficient contact pressure being a result of wear in one of the control mechanism, a kinematic chain, the motor, and parts involved in compressing the closure spring, or in an event of incomplete closure exclusive of any wear, the method comprising:

detecting whether the motor completes the closure maneuver and whether a resetting torque corresponds to a normal resetting torque by analyzing an envelope curve of current consumed by the motor over time in order to carry out the resetting following the closure maneuver of the control mechanism;

if the motor completes the closure, deducing that the wear is the result of wear in one of the control mechanism and the kinematic chain; and if the motor completes the closure and if the resetting torque corresponds to an abnormal resetting torque, deducing that the wear corresponds to wear in one of the motor and the parts involved in compressing the closure spring.

2. The detection method according to claim 1, wherein it is detected that the motor has completed the closure by analyzing the envelope curve of current consumed by the motor over time, in order to carry out the resetting following the closure maneuver of the control mechanism, and by verifying whether a duration of said current has increased compared to a normal duration, corresponding to complete closure, with this increase in the duration of the current being characteristic of wear in the control mechanism, the kinematic chain, or of incomplete closure exclusive of any wear.

3. The detection method according to claim 2, wherein the envelope curve of current consumed by the motor for the resetting is compared with a standard curve, corresponding to the envelope curve of current consumed by the motor when the closure maneuver carried out by the control mechanism is complete, and it is thereby deduced whether or not the closure has been completed.

4. The detection method according to claim 2, wherein a range of duration of the current passing through the motor is defined and, for any current duration found within this range, it is deduced that there is normal operation without wear in the motor and in specific parts of the mechanism for compressing the closure spring.

5. The detection method according to claim 1, wherein it is detected that the motor encounters a normal or particularly high resetting torque by analyzing the envelope curve of current consumed by the motor over time, in order to complete the resetting following the closure maneuver of the control mechanism, and by verifying whether a current level has increased compared to a normal level corresponding to a case whereby there is neither wear in the motor nor wear in specific parts of the mechanism involved in compressing the closure spring.

6. The detection method according to claim 5, wherein an envelope is defined that is delimited by two end curves, and any envelope curve of current located between these two envelope curves expresses normal operation of the motor and of the parts involved in compressing the closure spring.

7. A detection device for implementing a method according to claim 1, wherein said detection device comprises current detection means that is connected to means for powering the motor, and a processing algorithm configured to compare the envelope curve of current consumed by the motor for the resetting, over time, with a normal curve, corresponding to at least one of complete closure maneuver carried out by the control mechanism and a normal resetting torque.

8. The detection device according to claim 7, wherein said detection device comprises current detection means that are connected to the means for powering the motor, and a processing algorithm able to compare the envelope curve of current consumed by the motor for the resetting, over time, with at least one of two end envelope curves and a normal range of duration, and configured to determine whether this envelope curve of consumed current is found within or even outside the envelope, or even whether a current duration is found within or outside the range.

9. The detection device according to claim 7, wherein said resetting means comprises means for storing a closure energy in the control mechanism.

10. The detection device according to claim 7, wherein said detection device comprises means for locally or remotely indicating a detection of one of wear conditions.

11. An electrical switching unit, wherein said electrical switching unit comprises the detection device according to claim 7.

12. The electrical switching unit according to claim 11, wherein said electrical switching unit is an OCO circuit breaker, comprising means for resetting the control mechanism of the circuit breaker that is configured to return the control mechanism to a position in which said control mechanism is ready to close, following a closure maneuver.

* * * * *